United States Patent [19]

Archambaud et al.

[11] 4,277,202

[45] Jul. 7, 1981

[54] POSITIONING OF THE END OF AN UNDERWATER FLOWLINE

[75] Inventors: Denis G. Archambaud, Paris; René M. Dermy, Evry, both of France

[73] Assignee: Compagnie Francaise des Petroles, Paris, France

[21] Appl. No.: 35,179

[22] Filed: May 2, 1979

[30] Foreign Application Priority Data

May 12, 1978 [FR] France ..... 78 14242

[51] Int. Cl.[3] ..... E21B 43/01; F16L 1/00

[52] U.S. Cl. ..... 405/169; 166/343; 166/347

[58] Field of Search ..... 405/169, 170, 171; 166/343, 345, 338, 340; 285/18, 24, 27

[56] References Cited

U.S. PATENT DOCUMENTS

| | | | |
|---|---|---|---|
| 3,298,092 | 1/1967 | Dozier et al. | 405/169 X |
| 3,373,807 | 3/1968 | Fischer et al. | 405/169 X |
| 3,701,261 | 10/1972 | Nolan | 405/169 |
| 3,775,986 | 12/1973 | Daughtry | 405/169 |
| 3,846,992 | 11/1974 | Liautaud | 405/169 |
| 3,973,625 | 8/1976 | Baugh | 166/343 |
| 4,120,171 | 10/1978 | Chateau et al. | 405/169 |
| 4,133,182 | 1/1979 | Chateau | 405/169 |
| 4,161,367 | 7/1979 | Cuiper et al. | 166/343 |

*Primary Examiner*—Dennis L. Taylor

*Attorney, Agent, or Firm*—Sughrue, Rothwell, Mion, Zinn and Macpeak

[57] ABSTRACT

In the automatic positioning of the end of an underwater flow line, particularly in deep water, on a base, the end of the flow line is lowered to a position adjacent a connecting sleeve. The end of the flow line is connected to a hauling cable extending through the sleeve and a pull is exerted on the cable to draw the end of the flow line into the sleeve. The sleeve is detachably mounted on positioning apparatus mounted on the base and pivotable relative thereto in azimuth and elevation to align with the flow line. When the end of the flow line has been received in the sleeve and locked thereto, the sleeve is positioned on the base, locked thereto and released from the apparatus which is withdrawn.

29 Claims, 16 Drawing Figures

POSITIONING OF THE END OF AN UNDERWATER FLOWLINE

The invention relates to the automatic positioning of the end of an underwater flow line bundle comprising one or a plurality of pipes, particularly but not exclusively in deep waters.

There already exist devices comprising a cable guided by a pulley, which are designed for bringing the end of an underwater flow line bundle to a well-defined point, in order to be locked to a connector at this point. However, all these devices necessitate the use either of divers or of guide lines connecting a surface support to the fixing location of the end of the flow line bundle, thus rendering the positioning of the flow line bundle very difficult, if not impossible, as soon as a certain depth is reached, inter alia because of the difficulty involved in keeping the guide lines apart.

In addition, regardless of the method used for positioning the flow line bundle by means of a hauling cable, which pulls the end of the flow line bundle up to a sleeve for guiding the end of the flow line bundle to the appropriate connector, the forces exerted on the flow line bundle are such that no appreciable discrepancy can be tolerated between the direction assumed by the cable and the axes of the flow line bundle and of the sleeve, it only being possible to correct a small discrepancy, using these methods, when the flow line bundles are of small diameter.

According to the present invention there is provided a process for the automatic positioning of the end of an underwater flow line bundle in a locking position on a predetermined point of a base by means of apparatus including a hauling cable connected by one end to the end of the flow line bundle, and a pulley for guiding said cable which is lowered, the process comprising: in a first stage introducing said end of said flow line bundle into an adjustable connecting sheath on said apparatus and locking it relative thereto, said connecting sheath being allowed to orientate itself freely under the stress exerted by said hauling cable, and, in a second stage, displacing and locking said connecting sheath onto said locking position.

Preferably said connecting sheath is mounted on a support on said equipment, said support being freely adjustable in inclination and in azimuth, and said apparatus is orientated relative to said base.

Said support may comprise means for rotation in azimuth and means for rotation in inclination, so that, when said flow line bundle has been connected to said sheath, a simple rotation in azimuth and in inclination of said support suffices to bring said connecting sheath into its locking position on the base.

Any risk of tangling between lengths of cable can be eliminated by initially fixing the one end of the hauling cable to a winch on a surface support, and by fixing the other end of the cable to the end of a set of rods used to lower said apparatus onto said base, the cable passing through said connecting sheath and along the groove of said pulley, by locking said apparatus onto said base, by fixing the one end of said hauling cable to a cable for suspending said end of said flow line bundle, and by lowering said suspension cable whilst raising said set of rods carrying said other end of said hauling cable, in such a way that said end of said flow line bundle is gradually brought towards said apparatus until said end of said flow line bundle engages freely in said sheath under the action of said hauling cable, after freeing said suspension cable from said end of said flow line bundle.

By lowering the set of rods carrying the apparatus for aligning the flow line bundle and its connecting sheath by means of a re-entry device ensuring the automatic guiding of the apparatus onto said base, it is seen that one of the cables used cannot, at any moment, tangle with the other cable.

In addition, the re-entry means or an attached device, for example an ultrasonic device, may be utilised for checking the correct coincidence of the plane defined by the axis of the end of the flow line bundle and the suspension cable, during its displacement, with the vertical plane passing through the axis of the location reserved for the locking of the connecting sheath on the base, so as to reduce any excessive discrepancy whilst said suspension cable is being lowered and brought closer to said connecting sheath.

Thus, when the flow line bundle is resting on the sea bed and is connected by its said end to said connecting sheath, which can move both in azimuth and in inclination, it suffices to exert a relatively small force on said support of said connecting sheath in order to bring said connecting sheath into the locking position on said base and to proceed to haul in the connecting sheath.

According to a further aspect of the invention there is provided apparatus for carrying out the above process, comprising a pulley, a connecting sheath and a support arm comprising locking and releasing means for detachably connecting said sheath thereto, said sheath comprising means for locking to a locking position zone on a base for receiving said apparatus.

The apparatus may include a support for the sheath, which support is rotatable about a horizontal axis and a vertical axis, means for connection to a base provided with a location for locking the connecting sheath, means for displacing said support about said axes to bring said connecting sheath into the locking position on the base, and means for connection to a set of rods provided with a device for coupling to the hauling cable.

The invention will be more fully understood from the following description of embodiments thereof, given by way of example only, with reference to the accompanying drawings.

Figure 1:
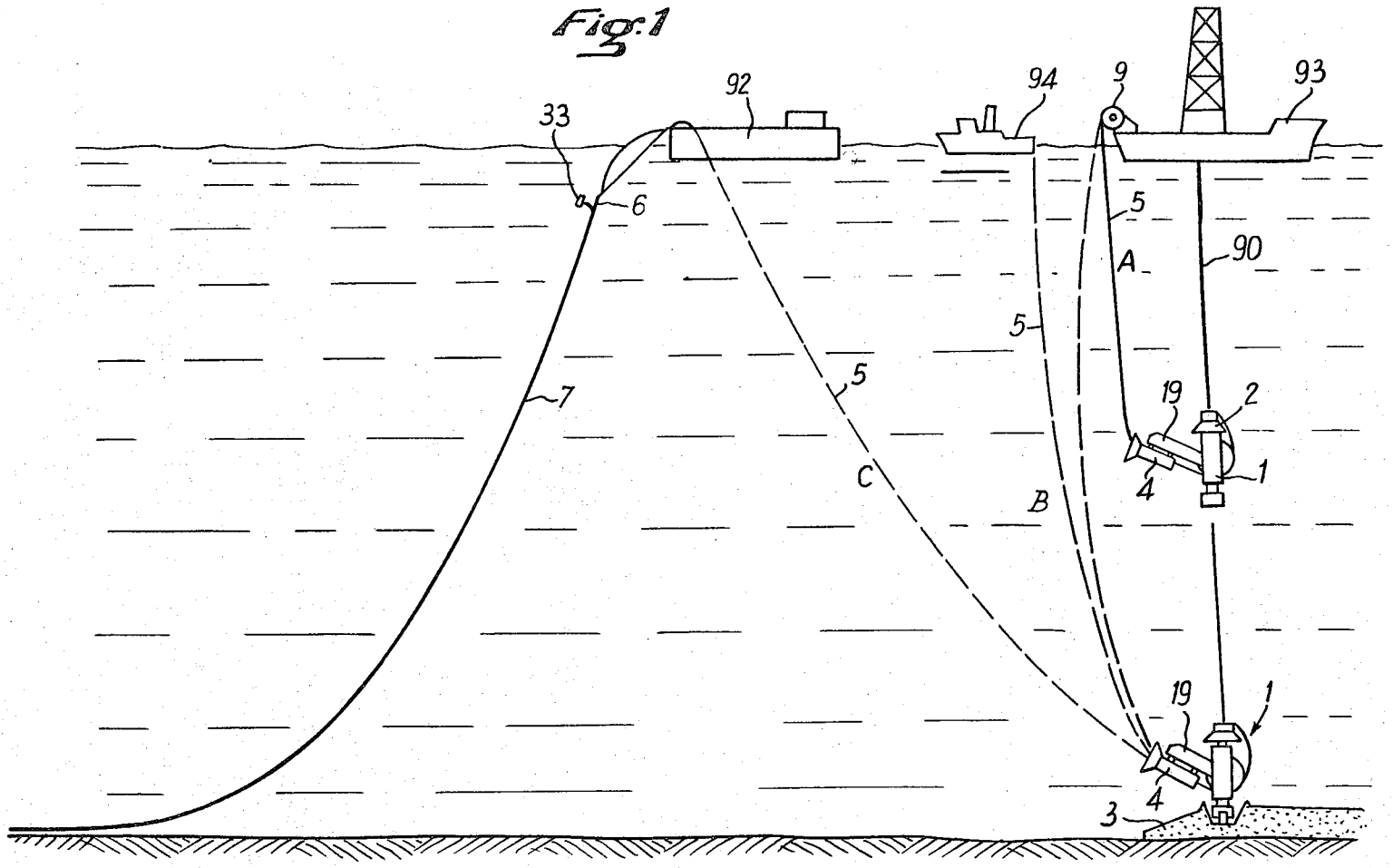
FIG. 1 shows diagrammatically the successive positions of a flow line bundle hauling cable during the first stages of an embodiment of a process according to the invention.
Figure 2:
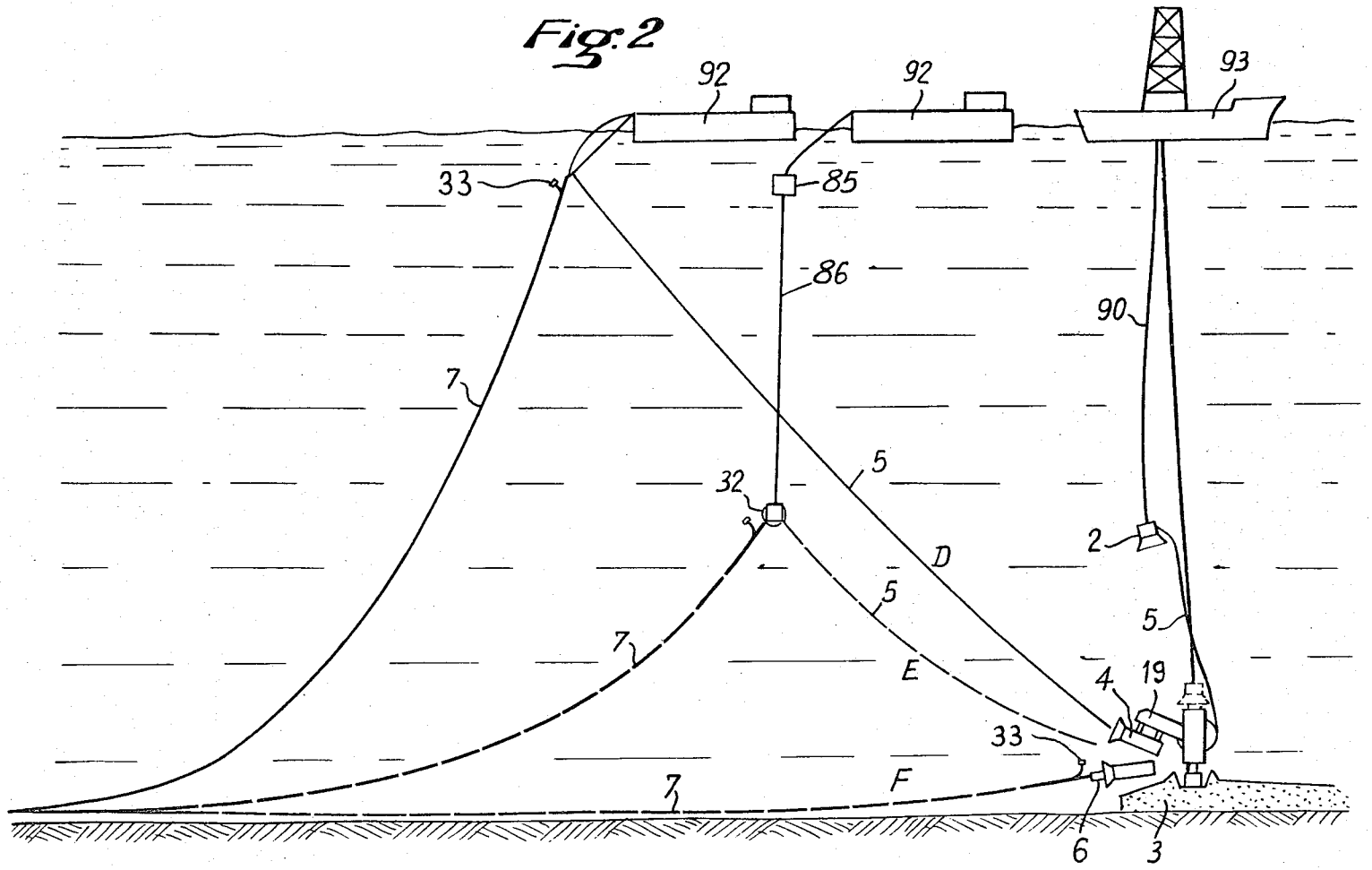
FIG. 2 shows diagrammatically successive intermediate positions of the cable.
Figure 4:
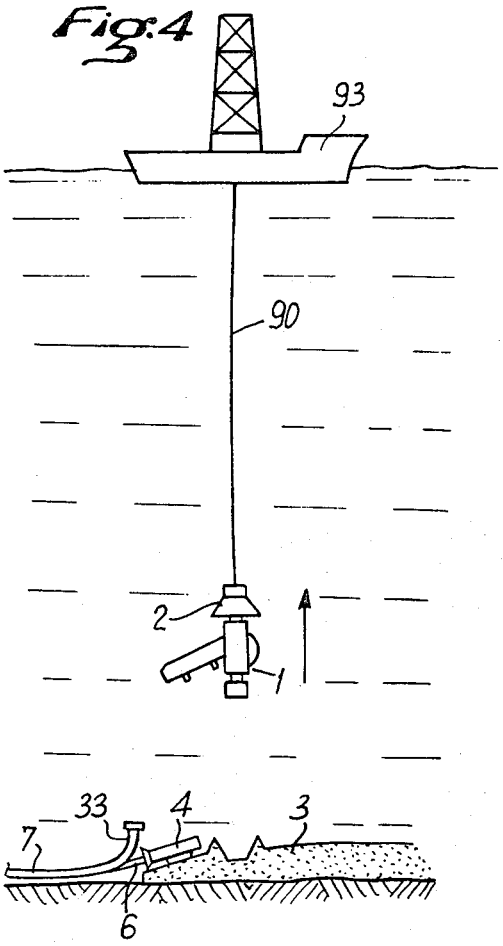
FIG. 4 shows diagrammatically the last stage of the process.
Figure 6:
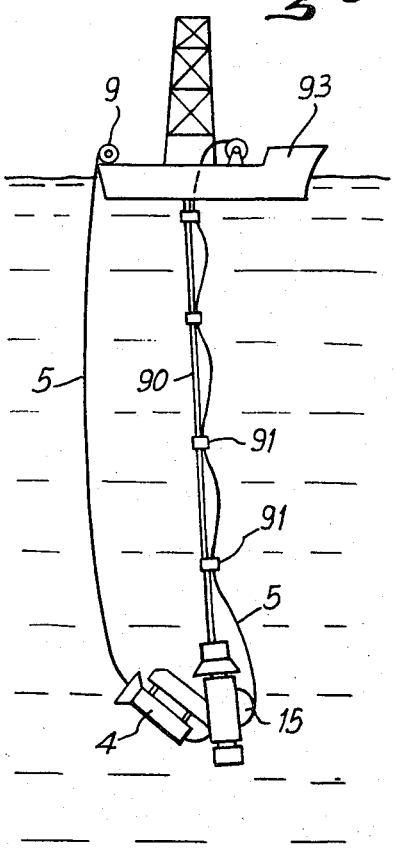
Figure 5A:
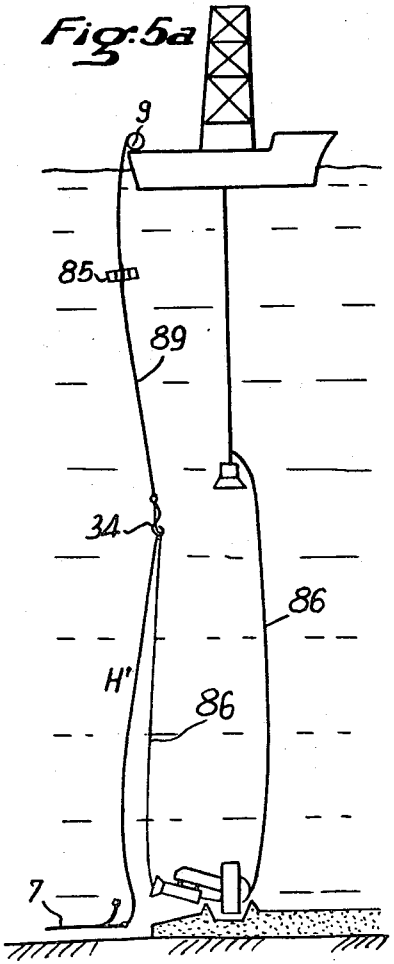
Figure 5:
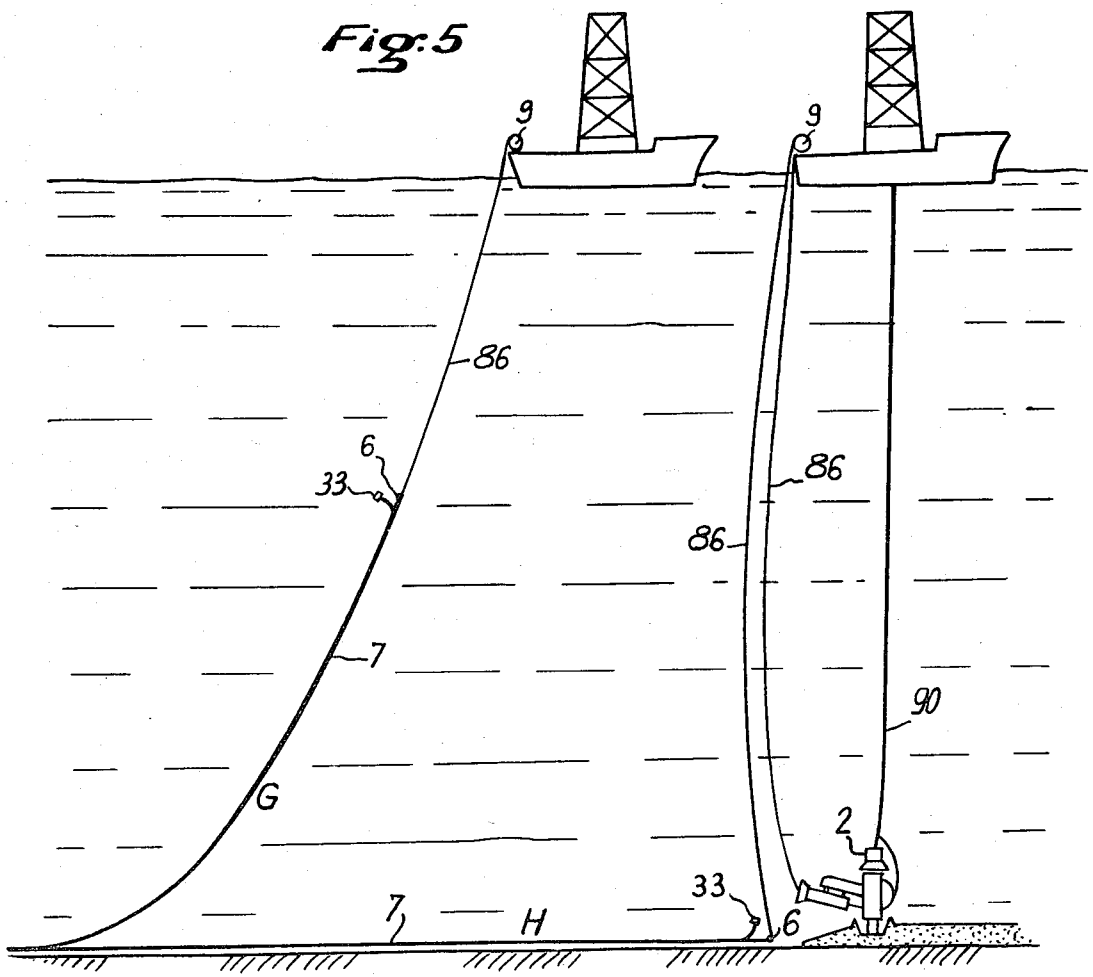
Figure 7:
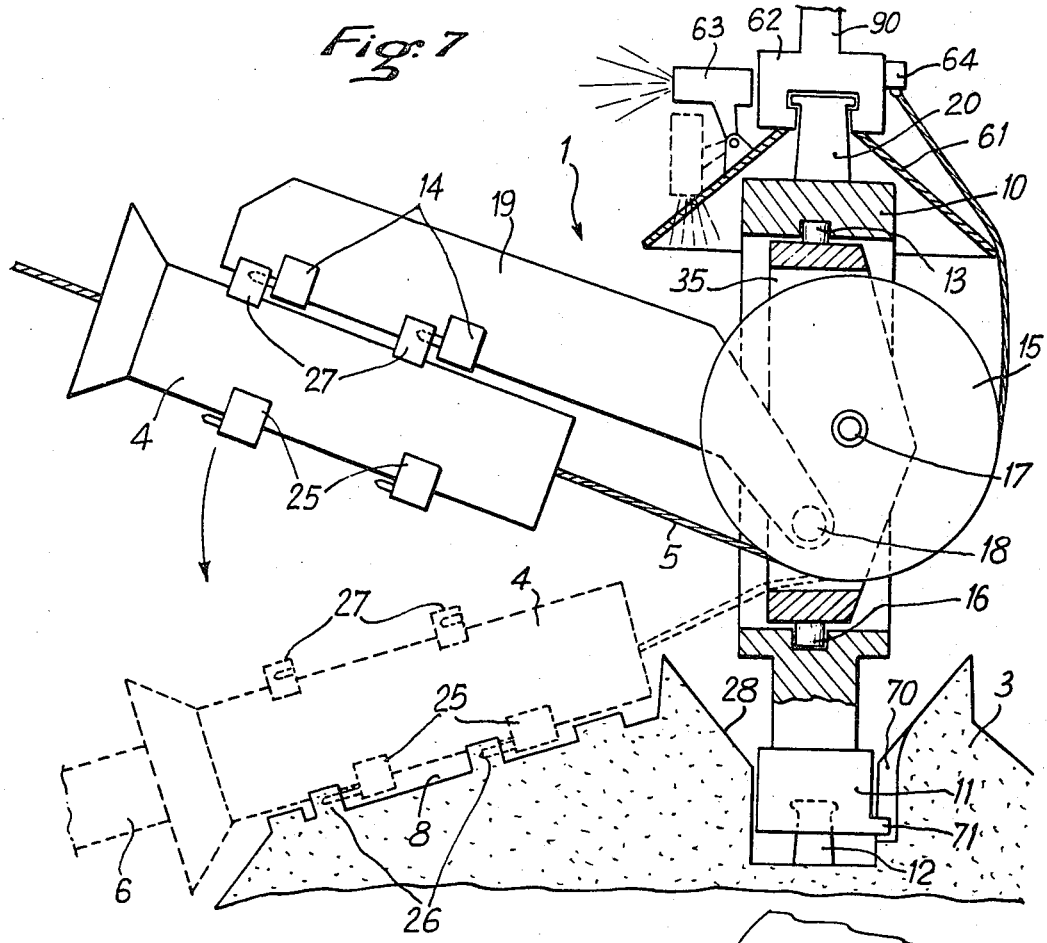
Figure 14:
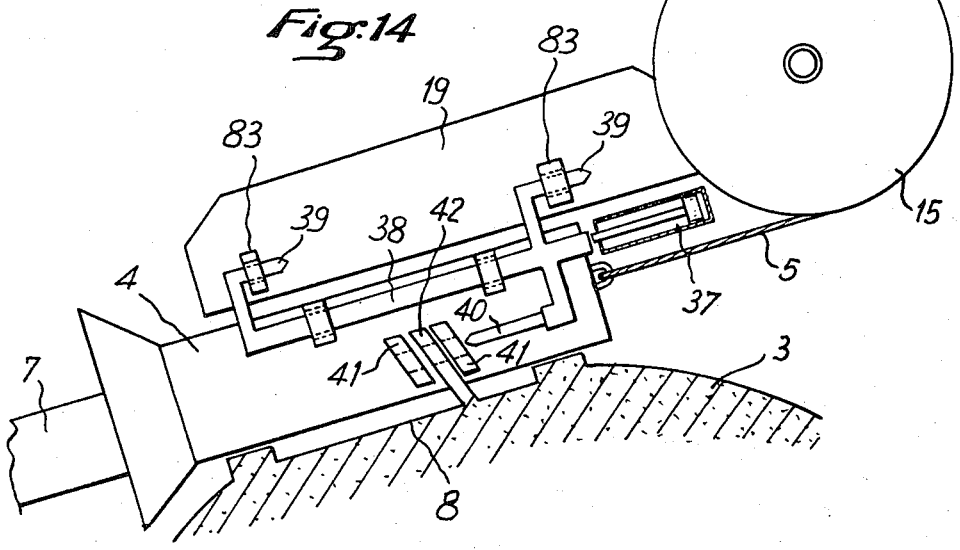
Figure 10:
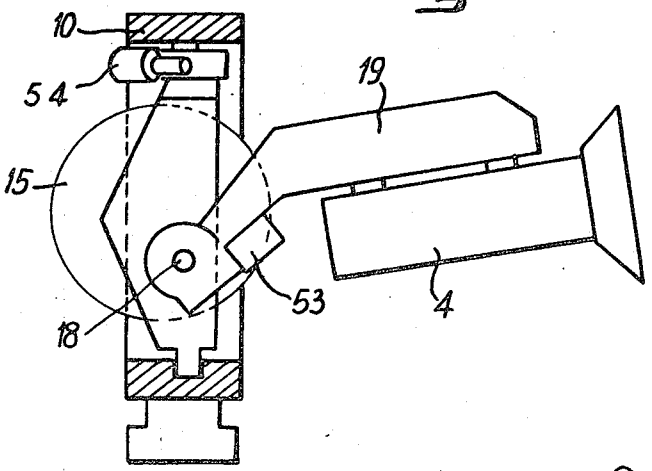
Figure 11:
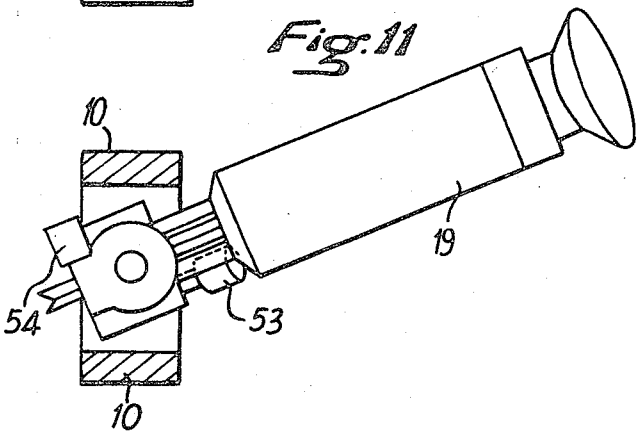
Figure 8:
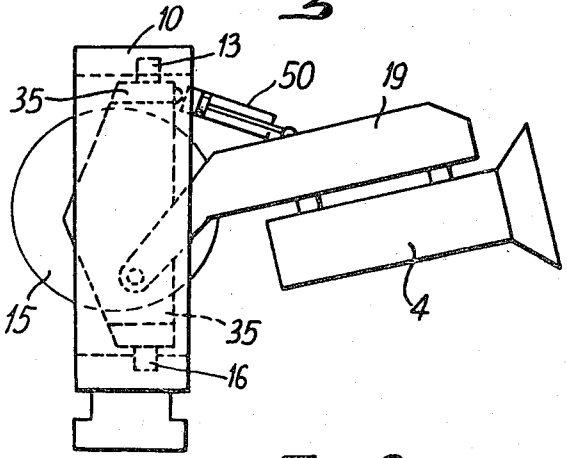
Figure 9:
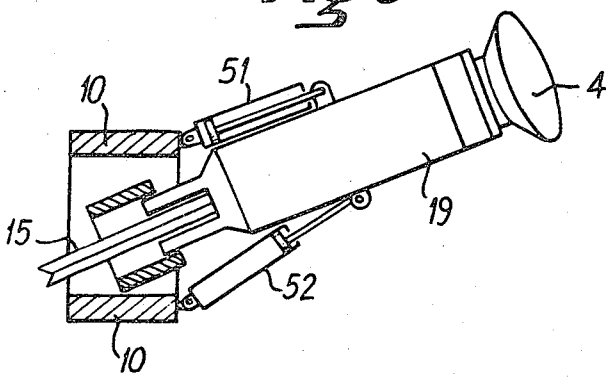
Figure 12:
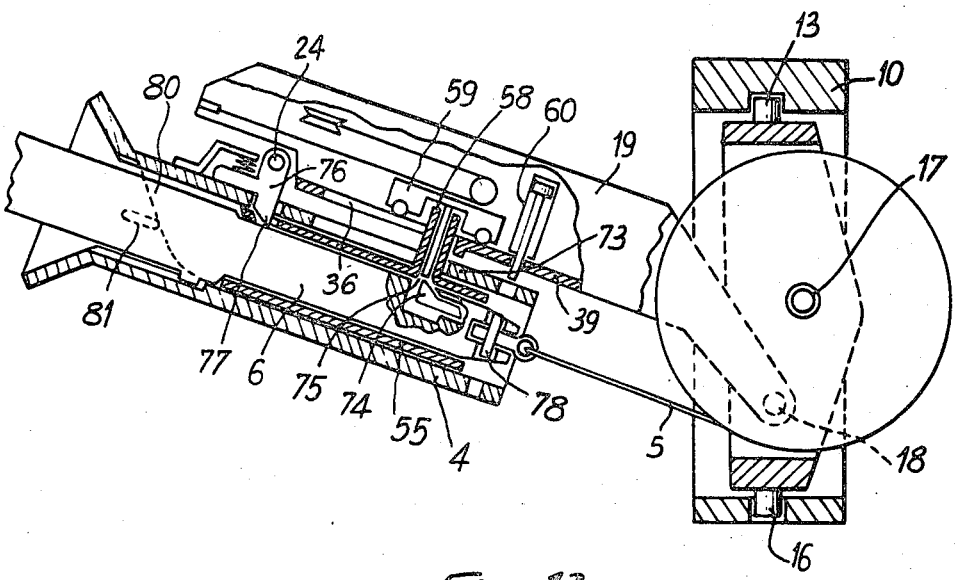
Figure 13:
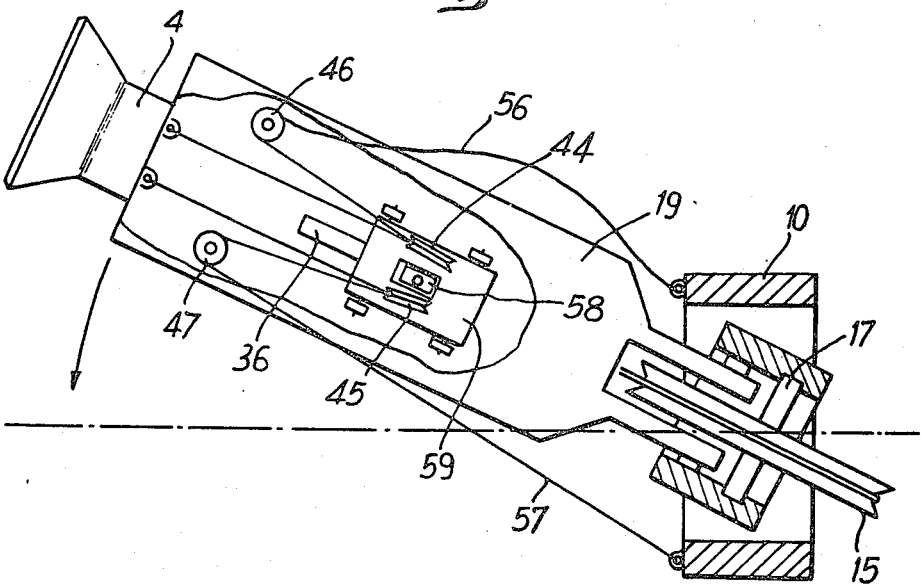
Figure 15:
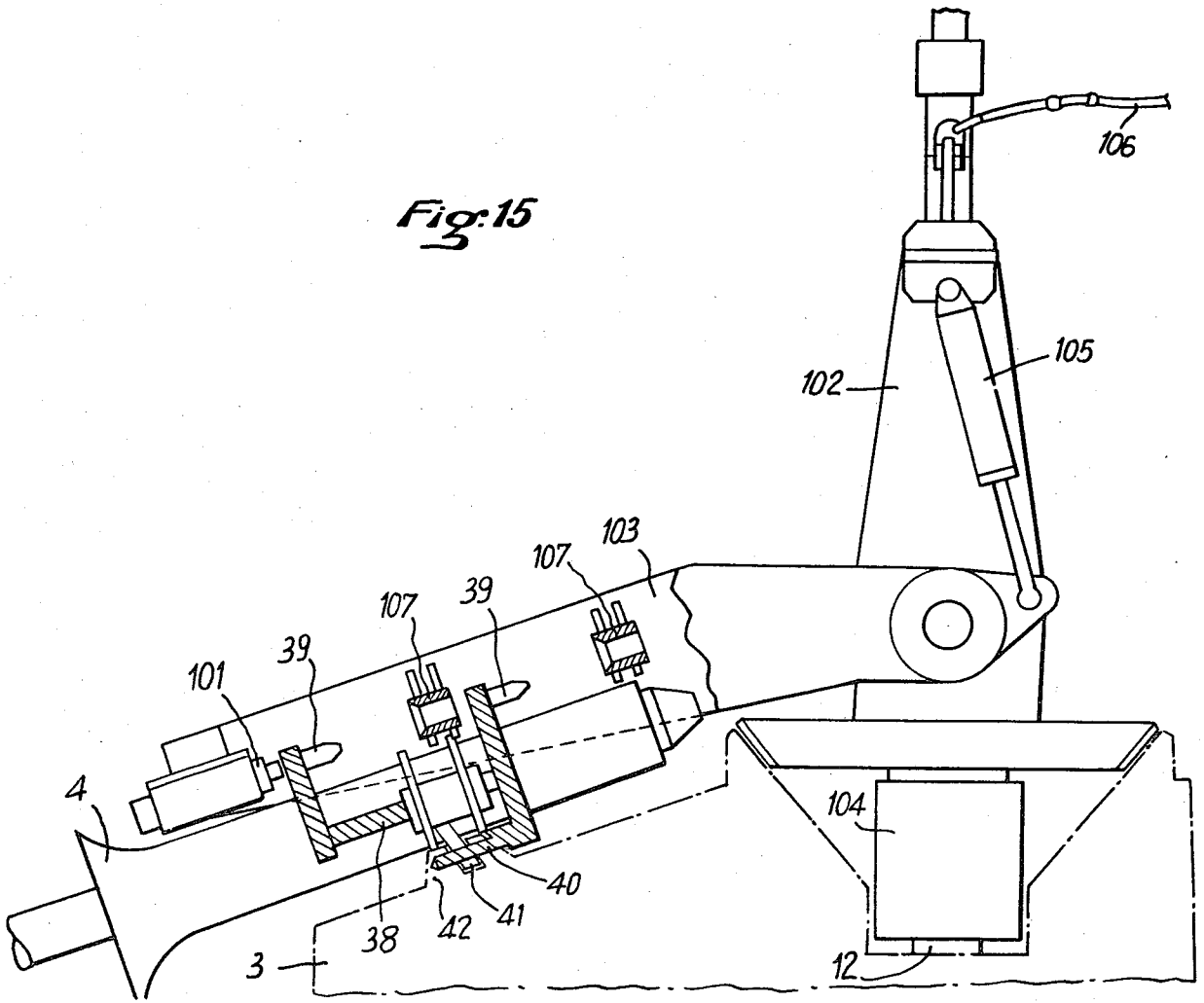

FIGS. 5 and 5*a* show the successive stages of the cable according to modifications of the process shown in FIGS. 1, 2 and 4;

FIG. 6 is a schematic representation of a guide means for the hauling cable;

FIG. 7 is the general schematic representation of the structure of the support of an embodiment of a connecting sheath, before and after it has been locked to a base;

FIG. 8 is the schematic view in elevation of the support of the connecting sheath and of means for controlling its inclination;

FIG. 9 is the schematic plan view of means for controlling the azimuth of the connecting sheath;

FIG. 10 is the schematic view in elevation of a modification of the means for controlling the inclination and the azimuth of an arm carrying the connecting sheath;

FIG. 11 is the schematic plan view of the means shown in FIG. 10;

FIG. 12 is the schematic view in section of the connecting sheath on its support, shown in elevation and partially cut away;

FIG. 13 is the plan view, with a cut-away section, of the support of FIG. 12;

FIG. 14 is the schematic view of part of the base carrying the connecting sheath; and FIG. 15 shows a tool for recovering the sheath.

The first stages of the embodiment of the process for positioning the end of the flow line bundle 7 are illustrated in FIG. 1 by the positions A, B and C of a hauling cable 5, the purpose of which is to guide the end of the flow line bundle 7, initially suspended from a surface support 92, until it is fixed to a base 3 in a predetermined position.

For this purpose, apparatus or equipment is lowered from a surface support 93 vertically above the base 3 by means of a set of rods 90, this equipment 1, which can be seen more clearly in FIG. 7, comprising a pulley 15, an articulated arm 19 and a connecting sheath 4. The hauling cable 5, fixed at one of its ends to a connector 2 of the set of rods 90 passes around the pulley 15, inside the connecting sheath 4 and is connected at its other end, in its position A, to a winch 9 on board the surface support 93 from which it is unwound as equipment is lowered.

When the equipment 1 reaches the base 3 and locks itself thereto at 12, the end of the cable connected to winch 9 is disconnected therefrom and the length of cable 5 joining the equipment 1 to the surface is displaced, for example by means of a tug 94, from the position B to the surface support 92 into position C.

Figure 3:
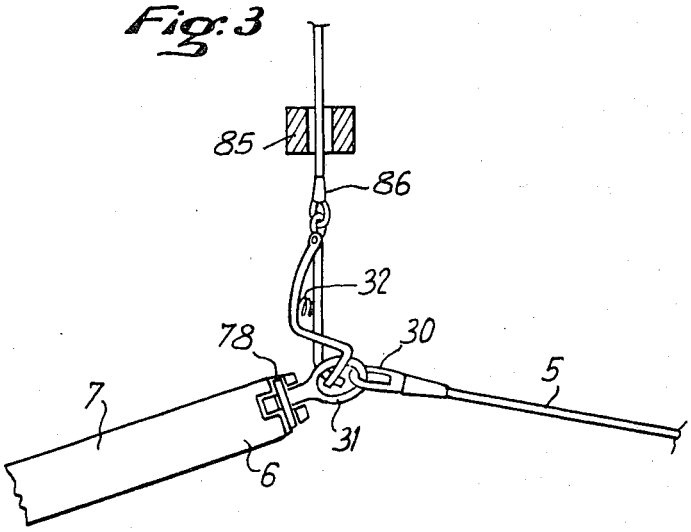
FIG. 3 shows in detail means for fixing a suspension cable to the end of a flow line bundle.

The end of the flow line bundle 7 is then connected, as also shown in FIGS. 2 and 3, to the cable 5 by means of rings 30 and 31, ring 31 being connected to the end of the flow line bundle 7 by means of a pin 78, and to a suspension cable 86 by means of pincers 32 with automatic opening. Opening of the pincers is effected by the fall of a carrier tool 85, in the form of a ring, which is dropped from the surface. The successive positions adopted by the cable 5 are illustrated by D and E respectively in FIG. 2.

It will be noticed that it is easy to carry out the successive operations which have now been described, whilst retaining a suitable orientation of the equipment 1, because, during the descent of the equipment, the set of rods 90 can enable it to retain a general orientation in which the arm 19 is constantly directed towards the flow line bundle 7. It is also possible to provide means on connector 2 for the automatic orientation of the equipment 1 during its descent, as well as means 70–71, FIG. 7, for automatic positioning and orientation as the equipment is connected to the base 3, so that the axis of the connecting sheath 4 is always in the direction of that of the flow line bundle 7. It is also possible to check, for example by means of a camera, such as camera 63, FIG. 7, that the orientation of the equipment 1 is correct during the unwinding of the hauling cable 5 in position A. Similarly, when the equipment 1 is connected at 12 to the base 3, FIGS. 1 and 7, and when the cable 5 is displaced from position A to position D in which it is connected to the end of the flow line bundle 7, the entire operation can be observed by the camera. Moreover, the arm 19, supporting the connecting sheath 4 of the equipment 1, is designed to sweep a sufficient angle for the variations in azimuth of the cable 5 not to cause the dislodging of the cable from the groove in the pulley 15 during the successive displacements of the cable 5 passing through the connecting sheath 4.

During the displacement of the cable 5 from position D to position E, the set of rods 90 raises the connector 2 and a length of the cable 5 fixed to the connector 2, whilst the suspension cable 86 controls the lowering of the flow line bundle 7, which is controlled at the same time as the surface support 92 is displaced towards the surface support 93. When the end of the flow line bundle 7 is in the vicinity of the base 3, the suspension cable 86 is detached from the ring 31 by simply releasing the carrier tool 85 which, when it falls, opens the pincers 32. The cable 86 is then raised to the surface, whilst the flow line bundle 7 assumes the position represented by F. It is then only necessary to exert a pull on the cable 5 to ensure the introduction of the end of the flow line bundle 7 into the connecting sheath 4. It then suffices to carry out the automatic transfer of the connecting sheath 4, FIG. 4, from the equipment 1 to the base 3, and then to raise the equipment 1 by means of the set of rods 90, in order to have the flow line bundle at a precise predetermined point on the base 3. Since most of the automatic connections are effected vertically, a traction head, such as head 6, FIGS. 2 and 12, is fixed to the end of the flow line bundle, the only purpose of this traction head being to cooperate with the connecting sheath 4 in order to enable the mouth 33 of the flow line bundle to present itself with a well-defined orientation. In the embodiment chosen, this orientation corresponds to a position in which the mouth 33 of the flow line bundle can be connected to any suitable connector which is lowered vertically, the traction head 6 being used only to ensure its precise positioning.

It is clear that the process which has been described can be carried out in various ways. For example, the same surface support 93, FIG. 5, can, for example, haul the flow line bundle 7 by means of a cable 86 in order to bring it gradually from position G to position H, by directing itself until it is vertically above the base 3 and by lowering the end of the flow line bundle until the end is near the base 3. As has already been explained, one end of the length of cable 86 located at the surface can be fixed to the connector 2 of the set of rods 90 by passing inside the connecting sheath 4 and around the pulley 15. The equipment 1 can be lowered either as shown by H, that is to say by having a sufficient length of cable 86 to form a loop, the upper end of which is kept at the surface, or as shown in FIG. 5*a* by only using a fraction of this length and by lowering it at the same time as the equipment 1 by means of an auxiliary cable, such as the cable 89, which is equipped with pincers 34 with automatic opening, in order to guide the end of the loop H′ which is lowered, and then to release it when the set of rods 90 is raised after positioning the equipment 1 on its base 3.

Similarly, instead of lowering the equipment 1 and the hauling cable 5 with one end fixed to the connector 2, in order to facilitate the raising thereof, it is possible to leave both ends of the cable 5 on the surface, as shown in FIG. 6, one of the lengths of the cable ascending along the set of rods 90 by sliding inside collars 91, each collar comprising one part which presses on the rods 90, the other part providing a passage for the cable 5. Tangling of the two lengths of this cable can thus be avoided with certainty and it is possible to introduce the end of the flow line bundle into its sheath without having to raise the set of rods immediately.

One embodiment of the equipment 1 used for guiding the cable 5, the purpose of which cable is to introduce the end of the flow line bundle 7 or of the traction head 6 of the flow line bundle 7 into the connecting sheath, and for the transfer of the connector onto the base 3, has been represented schematically in FIG. 7.

The equipment 1 comprises a main frame 10 which carries, at its lower part, a connector 11 provided with a guide finger 71, and, at its upper part, a connecting member 20 which is provided for locking to a connector 62 of a guide head 61 carried by the set of rods 90. This head 61 possesses coupling means 64 for the guide cable 5, and also all the so-called re-entry devices for use as soon as the depth at which the flow line bundle 7 is to be connected makes this necessary. Moreover, an adjustable television camera 63 makes it possible to ensure the correct orientation of the equipment 1 and also to make sure of the conditions under which the assemblies of the means used, including the guide cable 5, for positioning the flow line bundle 7 are presented.

The connector 11, which is intended for locking onto the member 12 of the base 3, is arranged so as to cooperate with a conical guide surface 28, the finger 71 sliding over an orientation ramp 70. Thus, the frame 10 assumes a well-defined orientation relative to the base 3.

The frame additionally carries a support 35 which is pivotable relative to the frame 10 about vertical axis shafts 13 and 16. The support 35 is provided with a horizontal axis shaft 17 about which the pulley 15 pivots, and a horizontal axis shaft 18 about which the alignment arm 19 pivots, the arm 19 carrying the connecting sheath 4 for the end of the flow line bundle 7 or its traction head 6. This arm 19 comprises locking means 14 which cooperate with fixing means 27 carried on the upper part of the connecting sheath 4. The lower part of the connecting sheath 4 comprises locking means 25 for cooperation with fixing means 26, provided on the base 3, for receiving the connector 4 in a predetermined position.

During the engagement of the end of the flow line bundle 7 in the connecting sheath 4, the alignment arm 19 adjusts itself freely under the action of the reaction forces due to the pulling of the guide cable 5.

The arm 19 carries a carriage 59 (FIGS. 12 and 13) which is driven and guided by a lug 58 integral or fast with a jacket 55 housed in the connecting sheath 4, the lug being displaced in a slot 36 in the arm 19. The carriage 59 moves over a surface 39 of the arm 19 and carries two pulleys 44, 45 with horizontal axes. Two cables 56 and 57 each have one of their ends fixed to the frame 10, the other ends being fixed to the end of the arm 19. These cables are tightened respectively by the pulleys 44 and 45 of the carriage 59, pulleys 46 and 47 being used to guide the lengths fixed to the frame 10.

When a pull is exerted on the cable 5, when it is detachably connected to the traction head 6 fixed to the end of the flow line bundle 7, a key 81 on the head 6 slides over a ramp 80 on the connecting sheath 4, this causing the rotation of the head 6 in order to enable the mouth of the flow line bundle to assume the desired position relative to the sheath. At the same time, the traction head 6 pushes back the jacket 55 which drives the carriage 59. The latter tightens the cables 56 and 57, gradually bringing the arm 19 back to the azimuth of the axis of the end of the flow line bundle. The moment of the pulling force exerted by the cable 5, relative to the shaft 18 of the arm 19, brings the latter back to the inclination of the axis of the end of the flow line bundle. The locking of the traction head 6 in the jacket 55 is effected by means of a bolt 74 which can rest on the base 75 of the lug 58, the locking of the jacket 55 to the connecting sleeve 4 being effected by means of a bolt 76. A hole 24 in the bolt 76 can be used to free its end 77 from the jacket 55.

With the arm 19 in its locking position, FIG. 14, in which position the sleeve 4 rests on the base 3, it is possible to act on a jack, such as jack 37, in order simultaneously to control the locking of the sleeve 4 to the base 3 and then the release of the arm 19. In fact, the thrust of the rod of the jack 37 on the rod 38 first causes the introduction of a bolt 40 into holes in clips 41 integral or fast with the sheath 4, and in clip 42 integral or fast with the base 3, and then causes rods 39 to disengage from clips 83 integral or fast with the arm 19.

In order to reduce the unavoidable discrepancy between the locking position 8 on the base 3 and the position of the connecting sheath 4, after introducing and locking the traction head 6, the inclination and the orientation of the arm 19, carrying the connecting sheath 4 and the traction head 6, are modified by means of linear jacks 50, FIG. 8, or rotary jacks 53, FIGS. 10 and 11, which make it possible to vary the inclination of the arm 19, the discrepancy in azimuth being corrected by means of a pair of linear jacks 51 and 52, FIG. 9, or by means of a rotary jack 54, FIGS. 10 and 11.

When it is desired to raise the cable 5 after fixing the connecting sheath 4 to the base 3, it suffices to use a jack, such as jack 60, FIG. 12, which is arranged so that its rod drives out the pin 78 holding the cable to the traction head 6.

An auxiliary tool can also be lowered in order to release the sheath 4 from the base 3 by simply pulling the rod 38. This tool can optionally be carried by the equipment 1. FIG. 15 illustrates, by way of example, the operation of such an independent tool. This tool comprises a frame 102 which, in the re-entry position, is attached to the coupling member 12 of the structure 3 by means of a connector 104. An arm 103 is positioned on the sheath 4 by means of a jack 105, so that an operating jack 101 on the arm 103 can act on the end of the locking rod 38, to release bolt 40 from the points of attachment 41 located on the base 3, and to engage bolts 39 in the coupling sleeves 107 mounted on brackets and shown in section. The sheath 4 and the traction head 6 are thus made fast with the frame 102 which can be raised to the surface by freeing the connector 104 from structure 3 and pulling on the rope 106 which is necessary for safely raising the flow line bundle. Although the shape of the rod 38 has been slightly modified in this Figure, it will be understood that this rod replaces that of FIG. 14, so that it is the same rod 38 which is driven in one or other direction, depending on whether it is controlled by the means of FIG. 14 or by that of FIG. 15. Thus, the sheath 4 can easily be brought up to the surface by itself or together with the traction head 6 fixed to the flow line bundle.

Although only one particular embodiment of apparatus for carrying out the process and of one of its variants has been described and shown, it is clear that all or part of these means can be replaced by equivalent means without going outside the scope of the invention, provided that these means make it possible to carry out the process, in accordance with which the orientation, in inclination and in azimuth, of a connecting sheath is effected freely during the introduction of the end of a flow line bundle or of a traction head which is fixed thereto, the hauling of the connecting sheath to the chosen locking point being effected, in the event of a discrepancy between the position assumed by the connecting sheath and the predetermined locking position, using auxiliary means.

There is thus provided a process in which the forces generated over the small or large discrepancies in azimuth and in inclination of the axis of the connecting sheath and of the axis of the end of the flow line bundle whilst they are being brought closer to one another, are eliminated, on the one hand by the free displacement, relative to its support, both in azimuth and in inclination, of the sheath for receiving the end of the flow line bundle, and on the other hand by accomplishing this operation in the region of the location which the end of the flow line bundle is to occupy.

The value of the above described process for positioning the flow line bundle is not only to facilitate the introduction and the locking of the end of the flow line bundle in a connecting sheath which is oriented freely relative to its support, but also to make it possible to reduce the forces which are to be exerted on the flow line bundle, these forces being taken up by the connecting sheath once the end of the flow line bundle is locked thereto when it is transferred to its predetermined locking position. This is achieved by making the location of the free junction of the connecting sheath and of the end of the flow line bundle close to the definitive location of the end of the flow line bundle or of the predetermined fixing location of the said sheath.

What is claimed is:

1. A process for positioning and locking the end of an underwater flow line bundle in a predetermined site on a seabed base, comprising the steps of:

(a) connecting one end of a hauling cable to the end of the flow line bundle, (b) guiding the other end of the cable through a connecting sheath freely pivotally mounted in both azimuth and elevation to an apparatus releasably mounted on said base, and around a pulley mounted on said apparatus and freely pivotable in azimuth, (c) drawing said other end of the cable toward the water surface to draw said end of the flow line bundle into the sheath, said sheath pivotally assuming an orientation during said drawing to minimize the bending deformation of the flow line bundle, (d) locking the end of the bundle in the sheath, (e) displacing said sheath into said site, and (f) locking said sheath to the base at said site.

2. A process as claimed in claim 1, wherein said connecting sheath is mounted on a support arm of said apparatus, said support arm being freely adjustable in inclination and in azimuth, and said apparatus is fixedly orientated in azimuth relative to said base in the direction of said end of said flow line bundle.

3. A process as claimed in claim 2, wherein said orientation of said apparatus is effected by sighting means during its lowering, including at least one of optical, radar and sonar means.

4. A process as claimed in claim 2, wherein said orientation of said apparatus is effected by sliding guide means on said apparatus over guide ramp means on said base.

5. A process as claimed in claim 1, wherein initially said one end of said cable is at the surface, the other end of said hauling cable is fixed to a connector on a set of rods supporting said apparatus, said apparatus is lowered, without a guideline, vertically above said base by unwinding said hauling cable from the surface, said apparatus is held on said base, said one end of said cable is connected, at the surface, to said end of said flow line bundle, which may be provided with a traction head, said end of said flow line bundle is lowered in the direction of said apparatus by raising said set of rods carrying said other end of the hauling cable, and a sufficient force is exerted on said hauling cable for the end of the flow line bundle to be introduced into said connecting sheath.

6. A process as claimed in claim 5, wherein said end of said flow line bundle is lowered by directing it towards the base by means of a suspension cable which is unwound from the surface, said suspension cable is displaced in the direction of a point below which said base is located, and said suspension cable is automatically freed from said end of said flow line bundle.

7. A process as claimed in claim 6, wherein said suspension cable is freed from the end of said flow line bundle when said end is in the vicinity of said sea bed, and said suspension cable is raised to the surface before freeing said hauling cable from said end of said flow line bundle.

8. A process as claimed in claim 1, wherein said end of said flow line bundle is carried by means of a suspension cable which is displaced in the direction of said site, said apparatus, carrying said connecting sheath which is detachable therefrom, is lowered by means of a set of rods having a connector which supports said apparatus and is connected to said other end of said hauling cable which, on board a surface support, is passed around said pulley on said apparatus and then into said detachable connecting sheath, said hauling cable is unwound from the surface, said surface ends of said suspension and hauling cables are connected and said set of rods is raised, tightening the loop formed by said hauling and suspension cables by means of a supporting cable, this cable is freed after reduction of said loop, and said connecting sheath is transferred onto said base.

9. A process as claimed in claim 1, wherein said end of said line bundle is carried by means of a suspension cable which is displaced in the direction of said locking position, the free length of said suspension cable is passed, at the surface, through said connecting sheath on said apparatus and then around said pulley before winding it onto a winch on the surface, said apparatus is lowered, tightening said suspension cable, said apparatus is connected to said base, said cable is then used as said hauling cable for introducing said end of said flow line bundle into said connecting sheath, and said sheath is locked to said base.

10. A process as claimed in claim 5, wherein the other end of said hauling cable remains connected at the surface during said lowering of said apparatus, the length of said cable between said other end and said apparatus being held by means of guides along said set of rods.

11. A process as claimed in claim 2, wherein, in the absence of marine current or excessive length, the transfer of said sheath containing said end of said flow line bundle from said support on said apparatus to said site on said base, is effected by releasing said sheath from said support and locking said sheath onto said base, without displacement of said support during said transfer.

12. A process as claimed in claim 2, wherein said support is automatically centered, in inclination and in azimuth, by simply pulling said hauling cable in order to bring said sheath into a position coincident with that of said site on said base.

13. A process as claimed in claim 1, wherein auxiliary control means are used for bringing the inclination and the azimuth of said connecting sheath back into a position coincident with said locking position on said base.

14. An apparatus for positioning and locking the end of an underwater flow line bundle in a predetermined site on a seabed base, comprising:

(a) a mounting frame, (b) a support arm pivotally mounted to the frame for free movement in both azimuth and elevation, (c) a pulley pivotally mounted to the frame for free movement in azimuth together with the support arm, (d) a hollow connecting sheath for receiving and locking the end of the flow line bundle, said sheath being releasably mounted on the support arm, (e) means for releasably positioning the frame on the base in a vertical attitude and in a predetermined orientation in azimuth relative to said site, and (f) means for locking the sheath to the base at said site, whereby a hauling cable may be connected to the end of the bundle at one of its ends and led through the sheath and around the pulley at its other end, the raising of its other end toward the surface thus serving to draw the end of the bundle into the sheath.

15. Apparatus as claimed in claim 14, wherein said arm is articulated on a horizontal shaft of a support member rotatable about a vertical axis, said pulley also being mounted on said support member.

16. Apparatus as claimed in claim 14, wherein said frame carries connecting means at an upper part for connection to an end of a set of lowering and raising rods.

17. Apparatus as claimed in claim 16, wherein said base comprises a guide cone provided with a guide ramp for receiving the mounting frame.

18. Apparatus as claimed in claim 16, wherein said upper part connecting means cooperates with a reentry head provided with observation means.

19. Apparatus as claimed in claim 16, wherein said upper part connecting means comprises means for fixing one end of a hauling cable.

20. Apparatus as claimed in claim 16, wherein said arm is provided with means which cooperate with said frame for orientating said sheath in azimuth.

21. Apparatus as claimed in claim 15, wherein said arm is provided with means which cooperate with said support for orientating said sheath in inclination.

22. Apparatus as claimed in claim 14, wherein said sheath comprises a guide ramp for cooperation with means for guiding a traction head on the end of the flow line bundle for enabling said end of said flow line bundle to assume a predetermined orientation.

23. Apparatus as claimed in claim 14, wherein said sheath comprises a movable jacket for receiving means for locking the end of the flow line bundle to said sheath, and means for locking said jacket in a position corresponding to the introduction and the locking of the end of the flow line bundle in said connecting sheath.

24. Apparatus as claimed in claim 23, wherein said arm is provided with a carriage carrying pulleys for tightening two cables for automatically positioning said arm, said carriage being driven by displacement of said jacket during the introduction and the locking of the end of the flow line bundle, each of said cables being fixed by one end to the end of said arm, and extending over a guide pulley fixed to said frame.

25. Apparatus as claimed in claim 14, wherein said arm is provided with means for releasing a hauling cable from the end of the flow line bundle.

26. Apparatus as claimed in claim 23, wherein said means for locking said jacket of said sheath is releasible.

27. Apparatus as claimed in claim 14, wherein means for mounting said connecting sheath to said arm comprises a control rod provided with two hooks for insertion in two clips on said arm, and a release jack having a rod which actuates said control rod.

28. Apparatus as claimed in claim 27, wherein said rod of said jack comprises a hook which cooperates with clips on said sheath and with a clip on the base for locking said sheath to the base, so that, during its action on said control rod, said rod of said jack also causes locking of said hook of said rod into said clips for locking said sheath to the base.

29. Apparatus as claimed in claim 27, wherein said control rod possesses locking clips which are arranged to cooperate with means for coupling to the said clips, which means are carried by an articulated arm on the frame of a tool for withdrawing said connecting sheath carrying the end of the flow line bundle, said tool comprising means for connection to the base and a jack on said arm for engaging said clips in said coupling means, so that said control rod frees said connecting sheath from the base and locks said connecting sheath to said withdrawal tool.

* * * * *